US005609669A

United States Patent [19]

Brunner

[11] Patent Number: 5,609,669

[45] Date of Patent: Mar. 11, 1997

[54] METHOD OF MANUFACTURING STAINLESS STEEL

[76] Inventor: Mikael Brunner, Tvärvägen 1, S-183 39 Täby, Sweden

[21] Appl. No.: 306,910

[22] Filed: Sep. 16, 1994

Related U.S. Application Data

[63] Continuation-in-part of Ser. No. 90,212, Nov. 22, 1993, abandoned.

[51] Int. Cl.[6] ..... C21C 7/068

[52] U.S. Cl. ..... 75/548; 75/554; 420/116; 420/71

[58] Field of Search ..... 420/115, 116, 420/71; 75/548, 554

[56] References Cited

U.S. PATENT DOCUMENTS

| | | | |
|---|---|---|---|
| 3,046,107 | 7/1962 | Nelson | 75/554 |
| 3,252,790 | 5/1966 | Krivsky | 75/554 |
| 3,728,101 | 4/1973 | d'Entremont | 420/71 |
| 3,854,932 | 12/1974 | Bishop | 75/555 |
| 4,619,694 | 10/1986 | Kawanobe et al. | 75/382 |

FOREIGN PATENT DOCUMENTS

| | | |
|---|---|---|
| 3541850A1 | 6/1987 | Germany . |

*Primary Examiner*—Melvyn Andrews
*Attorney, Agent, or Firm*—Pollock, Vande Sande & Priddy

[57] ABSTRACT

The invention relates to a method of manufacturing stainless steel, by treating a raw high-carbon steel in a first stage with a gaseous mixture that contains oxygen and inert gas, therewith lowering the carbon content of the raw steel to a value of 0.2–0.1%. The steel bath is then treated in a second stage with solely an inert gas, until the carbon content has fallen to the desired value. The invention is characterized in that the steel bath is treated in the first stage alternately with an oxygen-rich gas and with an inert gas, until the carbon content of the steel has fallen to the desired value.

11 Claims, No Drawings

METHOD OF MANUFACTURING STAINLESS STEEL

CROSS REFERENCE TO RELATED APPLICATION

This is a continuation-in-part of U.S. application Ser. No. 08/090,212, filed Nov. 22, 1993, now abandoned as a National Phase of PCT/SE92/00053 filed Jan. 28, 1992, entitled "Method of Manufacturing Stainless Steel."

It is known to produce stainless steel by processing high-carbon and high chromium molten metal with mixtures of oxygen gas and inert gas. During the decarburizing stage of the process, gaseous mixtures are blown into the melt and the ratio of oxygen gas to inert gas is changed progressively from an oxygen-rich mixture to an oxygen-lean mixture, as the carbon content of the raw steel diminishes. The method is known under the designation AOD, Argon Oxygen Decarburization.

The process is begun with a gaseous mixture that contains four parts of oxygen gas and one part of inert gas, or a gaseous mixture of 4/1. The carbon content of the steel at the beginning of the process is within the range of 1 to 2%. When the carbon content of the melt has fallen to about 0.8%, the oxygen gas/inert gas ratio is changed to 3/1, and then successively to 1/1 and finally to 1/3 at the end of the blow, when the carbon content of the steel has fallen to beneath 0.2%. This mixture ratio is then maintained until decarburization is complete, at which stage the carbon content should have fallen to the desired end carbon specification, that is below 0,05%.

In addition to carbon, some chromium is also oxidized during the blowing process. This oxidation of chromium represents a disadvantage, since chromium shall be recovered by reduction of chromium oxide with silicon. Silicon is an expensive alloy. The efficiency of the process can be measured by the quantity of silicon consumed.

The change in the mixing ratio between oxygen gas and inert gas is intended to avoid oxidation of chromium to the greatest possible extent. This can only be achieved partially under operating conditions, and consequently some chromium is always oxidized, resulting in the consumption of silicon for the reduction of chromium oxide.

The differing mixture ratios of oxygen gas to inert gas cause difficulties and time losses during the decarburizing process. For example, it is necessary to interrupt the process and to check the carbon content of the molten bath in order, to ascertain the correct mixture ratio to be used. Conventional interruptions and sampling processes prolong the process time, increase sampling costs and analysis costs and also increase the heat losses that occur during the process. It has been proposed that endeavors are made to calculate the carbon content of the bath with the use of expensive analysis instruments, without interrupting the process for the purpose of taking samples and sample analysis. Even though these endeavors achieve the result desired, the instrumentation required in this regard complicates the process of manufacture and therewith also results in higher costs for instrument investment and for maintenance.

An object of the present invention is to provide a decarburization process for the manufacture of stainless steel in which oxygen gas and inert gas are used without changing the oxygen to inert gas ratio to decrease as the carbon content decreases. The extent to which chromium is oxidized is equally as low, or still lower, as the level of chromium oxidation that occurs in the conventional method, in which the oxygen to inert gas ratio is lowered as the carbon content decreases.

According to the present invention, the decarburizing process is effected with only two mixtures of oxygen and inert gas and these two gas mixtures are used in an alternating manner.

One of the two gas mixtures is defined as an oxygen rich mixture of oxygen and inert gas, including technical oxygen with only traces of inert gas. The other gas mixture is an inert gas rich mixture of inert gas and oxygen, including technical pure inert gas with only traces of oxygen.

Example of oxygen rich gas mixture is 80% oxygen and 20% inert gas, nitrogen or argon. Example of inert gas rich mixture is 80% inert gas, nitrogen or argon, and 20% oxygen.

It shall be understood, that 90% oxygen and 10% inert gas is also an oxygen rich mixture of oxygen and inert gas and can be used according to the present invention. It shall be understood that the practical conditions will decide which oxygen content is optimal in a specific AOD vessel. 75% oxygen is also suitable, but oxygen contents as low as 50 to 60% oxygen in the oxygen rich gas mixture will probably not be optimal.

The same applies to the inert gas rich mixture. Pure inert gas as well as inert gas containing 5, 10 or 20% and more oxygen can be used according to the conditions in a certain AOD vessel. It is clear that air is regarded as inert gas rich mixture in this respect and can be used according to the present invention. Low inert gas contents such as 50 to 60% inert gas will in most cases not be optimal.

According to the present invention the oxygen rich gas should be as rich in oxygen as is practically possible, including pure oxygen. The inert gas rich mixture shall be as rich in inert gas as practically possible. It is understood, that what is practically possible will depend on the conditions in the treatment vessel, especially conditions at the tuyeres through which the gases are blown into the vessel.

The two gas mixtures are used in an alternating manner. For example the decarburization begins with blowing the oxygen rich gas mixture, thereafter the inert gas rich gas mixture is blown and thereafter the oxygen rich gas mixture again followed by the inert gas rich gas mixture and so on until the carbon content of 0,20–0,10 is reached.

The gas requirement from the initial carbon content down to 0,2 to 0,1% C is such, that more oxygen will be required, than inert gas. Thus, the blowing time for the oxygen rich gas mixture will be longer than that of the inert gas rich gas mixture.

The difference between the present invention and the conventional method is considerable and also fundamental. According to the conventional method, the chromium is safe-guarded against oxidation by the changed oxygen to inert gas mixture ratios. Oxidation of the chromium is restrained successively by mixtures which are progressively leaner in oxygen, while oxidation of the carbon is promoted at the same time. Thus, according to the conventional method, the purpose of the inert gas is to promote the oxidation of carbon as compared with the oxidation of the chromium.

The present invention is based on the use of a totally different mechanism. The periodically repeated injections of the inert gas rich mixture into the bath result in a chemical reaction between the carbon that is present in the bath and the oxygen that is bound to chromium in the form of chromium oxide. The chromium oxide is thus reduced with carbon during the injection of inert gas rich mixture into the melt.

This would explain the surprising fact that the process can be carried out without changing the oxygen to inert gas ratio in the gaseous mixture blown into the bath in the way suggested in the conventional AOD process without the risque of excessive chromium oxidation. On the contrary, the chromium oxidation during decarburization will be lower according to the present invention.

In practice, however, the most significant difference between the inventive method and the conventional method is found in the greater efficiency that is achieved when practicing the present invention, especially since the procedure of changing the mixture ratio between oxygen and inert gas at specific carbon contents is eliminated.

EXAMPLE 1

In a 70 ton AOD vessel a decarburization was performed by alternating blowing of two gas mixtures according the following scheme:

| blowing time min | O2 % | N2 % |
|---|---|---|
| 2 | 75 | 25 |
| 1 | 10 | 90 |
| 26 | 75 | 25 |
| 2 | 10 | 90 |
| 4 | 75 | 25 |
| 2 | 10 | 90 |
| 2 | 75 | 25 |

The start carbon was 0,86% and the carbon content after the above treatment was 0,18%. The heat was thereafter further decarburized to 0,008% end carbon content by conventional blowing technique and than reduced with ferro silicon. The silicon consumption was 10,3 kg/ton, compared with 11,5 kg/ton for the statistical reference blown according to standard AOD blowing technique with stepwise lowered oxygen to inert gas ratios.

EXAMPLE 2

In a 70 ton AOD vessel a decarburization was performed by alternating blowing of two gas mixtures according the following scheme:

| blowing time min | O2 % | N2 % |
|---|---|---|
| 26 | 75 | 25 |
| 2 | 10 | 90 |
| 4 | 75 | 25 |
| 2 | 10 | 90 |
| 3 | 75 | 25 |

The start carbon was 1,38% and the carbon content after the above treatment was 0,17%. The heat was thereafter further decarburized to 0,006% end carbon content by conventional blowing technique and than reduced with ferro silicon. The silicon consumption was 9,3 kg/ton, compared with 10,3 kg/ton for the statistical reference blown according to standard AOD blowing technique with stepwise lowered oxygen to inert gas ratios.

The silicon consumption was lower in Examples 1 and 2 compared with the statistical reference, indicating that less chromium was oxidized during decarburization in examples 1 and 2 compared with the standard AOD blowing procedure with decreased oxygen to inert gas ratios under decarburization.

I claim:

1. A method of producing stainless steel comprising:

a. providing a molten ferrous alloy containing chromium in a converter vessel, b. introducing oxygen rich gas containing at least 75% oxygen in amount sufficient to decarburize said molten alloy in a first decarburization period down to about 0.2 to about 0.1% carbon content, c. interrupting said introduction of the oxygen rich gas at least once during said first decarburization period by introducing an inert gas rich gas containing at least 80% inert gas, d. performing the rest of the decarburization down to an end carbon content by further treatment with gases containing inert gas and oxygen, e. performing reduction and finishing operations, and f. recovering a stainless steel product.

2. A method according to claim 1, wherein the introduction of the oxygen rich gas is interrupted twice.

3. A method according to claim 1, wherein the introduction of the oxygen rich gas is interrupted three times.

4. A method according to claim 1, wherein said gas rich gas contains at least 90% inert gas.

5. A method according to claim 4, wherein the introduction of the oxygen rich gas is interrupted twice.

6. A method according to claim 4, wherein the introduction of the oxygen rich gas is interrupted three times.

7. A method according to claim 1, wherein said alloy also contains nickel.

8. A method according to claim 1, wherein said inert gas is nitrogen.

9. A method according to claim 1, wherein said inert gas is argon.

10. A method according to claim 1, wherein said inert gas is air.

11. A method according to claim 1, wherein the oxygen content of the oxygen-rich gas is constant.

* * * * *